US011350680B2

(12) United States Patent
Rutkoski et al.

(10) Patent No.: US 11,350,680 B2
(45) Date of Patent: Jun. 7, 2022

(54) LEOTARD INCLUDING BUILT-IN SUPPORTIVE BRA

(71) Applicants: Celia Rutkoski, Paris (FR); Audrey Wilson, Paris (FR)

(72) Inventors: Celia Rutkoski, Paris (FR); Audrey Wilson, Paris (FR)

( * ) Notice: Subject to any disclaimer, the term of this patent is extended or adjusted under 35 U.S.C. 154(b) by 301 days.

(21) Appl. No.: 16/505,871

(22) Filed: Jul. 9, 2019

(65) Prior Publication Data

US 2020/0054079 A1 Feb. 20, 2020

Related U.S. Application Data

(63) Continuation-in-part of application No. 16/105,275, filed on Aug. 20, 2018, now Pat. No. 10,342,269.

(51) Int. Cl.
*A41C 3/08* (2006.01)
*A41C 3/00* (2006.01)

(52) U.S. Cl.
CPC ..... *A41C 3/08* (2013.01); *A41C 3/005* (2013.01); *A41C 3/0028* (2013.01)

(58) Field of Classification Search
CPC ... A41C 3/0028; A41C 3/0057; A41C 3/0014; A41C 3/12; A41C 3/122; A41C 15/002; A41C 3/21; A41F 1/006
USPC ..... 450/30–33, 86, 88; 2/67
See application file for complete search history.

(56) References Cited

U.S. PATENT DOCUMENTS 2,363,017 A 11/1944 Plehn
2,372,855 A 4/1945 Reid
2,445,449 A 7/1948 Moon
2,590,915 A 4/1952 Allison
3,157,187 A 11/1964 Murcott
5,033,986 A 7/1991 Feigenbaum et al.
6,155,906 A 12/2000 May
6,162,111 A * 12/2000 Heroff ..... A41D 7/00 450/30
6,179,687 B1 1/2001 Lee et al.
6,283,821 B1 9/2001 Wang
6,302,761 B1 10/2001 Wrenn
6,656,013 B1 12/2003 Wang
6,811,462 B1 11/2004 Kenneally
D503,026 S 3/2005 Sirimarco
7,938,711 B1 5/2011 Johnston
8,574,026 B2 11/2013 Livingstone
D709,670 S 7/2014 Vericella
D765,946 S 9/2016 DeCotiis
(Continued)

FOREIGN PATENT DOCUMENTS

JP 2005-206949 A 8/2005

OTHER PUBLICATIONS

An International Search Report and the Written Opinion of the International Searching Authority dated Oct. 22, 2019 in connection with international patent application No. PCT/US2019/038981.

*Primary Examiner* — Gloria M Hale
(74) *Attorney, Agent, or Firm* — Intrinsic Law Corp.

(57) ABSTRACT

A leotard having a built-in bra is disclosed. The leotard include a front panel and a back panel. A built-in bra is attached to the front panel of the leotard. A top back strap is attached to the bra at one end, the other end able to receive a fastener disposed on the bra. A bottom back strap is attached to the bra at one end, the other end able to receive a fastener disposed on the bra.

20 Claims, 15 Drawing Sheets

(56) References Cited

U.S. PATENT DOCUMENTS

| | | | | |
|---|---|---|---|---|
| 9,462,833 | B1 * | 10/2016 | Spaulding | A41D 7/00 |
| 10,342,269 | B1 * | 7/2019 | Rutkoski | A41C 3/0057 |
| 2002/0031978 | A1 * | 3/2002 | Heroff | A41D 7/00 450/30 |
| 2003/0157866 | A1 * | 8/2003 | Horii | A41D 7/00 450/31 |
| 2006/0189254 | A1 | 8/2006 | Hood | |
| 2008/0125011 | A1 | 5/2008 | Gleeson | |
| 2010/0317257 | A1 * | 12/2010 | Campbell | A41C 3/0028 450/39 |
| 2011/0201252 | A1 * | 8/2011 | Campbell | A41C 3/00 450/39 |
| 2011/0244757 | A1 * | 10/2011 | Mays | A41C 3/0021 450/31 |
| 2012/0244782 | A1 * | 9/2012 | Pundyk | A41C 3/0057 450/70 |
| 2012/0302135 | A1 * | 11/2012 | Solotoff | A41C 3/0007 450/52 |
| 2013/0237124 | A1 | 9/2013 | Hall | |
| 2013/0303050 | A1 | 11/2013 | Jackson | |
| 2014/0162530 | A1 * | 6/2014 | Wallace | A41C 3/08 450/32 |
| 2014/0162531 | A1 | 6/2014 | Mazourik et al. | |
| 2014/0349550 | A1 * | 11/2014 | Campbell | A41C 3/0021 450/60 |
| 2015/0258572 | A1 | 9/2015 | Lee et al. | |

* cited by examiner

LEOTARD INCLUDING BUILT-IN SUPPORTIVE BRA

CROSS REFERENCE TO RELATED APPLICATIONS

This application is a continuation-in-part of U.S. application Ser. No. 16/105,275 filed on Aug. 20, 2018, which is hereby incorporated by reference in its entirety.

FIELD OF THE INVENTION

The present invention relates to dancewear. More particularly, the invention relates to dance garments for use by dancers who need transparent/hidden built-in bras that can provide sufficient support in active applications such as dancing, figure skating, and other forms of sport or clothing where aesthetics matter.

BACKGROUND

Conventional dancewear may include leotards and one-piece or two-piece clothing made of stretchable material. Classical dancers are traditionally small in stature and bust size, and usually have little or no need for support from their leotard. In today's world, more and more dancer of all body types are taking dance classes, joining dance troupes, drill teams, etc. For wearer with larger busts, unsupported movement can be uncomfortable, diminish the appearance of the wearer, and may also lead to physical ailments such as back pain.

Built-in bras are known in the art. For example, U.S. Pat. No. 2,863,460 to Monroe discloses a brassiere built into a bathing suit. In addition, U.S. Pat. No. 8,574,026 to Livingstone discloses a leotard including a built-in bra. While these articles of clothing function in a conventional sense, they are not well suited for wearers with larger busts. In particular, the disclosed clothing and bra combination do not provide support for larger bust during active applications, while also maintaining an athletically pleasing design.

While conventional bras and sports bras can provide the required support for women with a larger bust, it is not always esthetically acceptable to wear a sports bra since the bra back and shoulder straps show under a dance leotard. As illustrated in FIG. 1, a conventional sports bra 100 is readily visible when worn under a conventional low-cut back leotard 200 worn by dancers.

Due to the limitations presented above, there is a need for a leotard and bra combination that supports wearer with a larger bust size that meets both active and aesthetic requirements for dancers and performers who would like a leotard with a built-in supportive bra.

BRIEF SUMMARY

In an embodiment, an article of clothing is described. The article of clothing includes a front panel and a back panel. The article of clothing further includes a brassiere attached to the front panel, the brassiere including a top fastener and a bottom fastener. The article of clothing further including a top back strap and a bottom back strap, where the top and back straps are attached to the brassiere on one end, and releasably coupled respectively to the top fastener and bottom fasteners.

The article of clothing may further include shoulder straps. One end of the shoulder straps may include fastening elements, which are used to secure the shoulder straps onto the brassiere. The shoulder straps are attached to the top back strap at the other end.

BRIEF DESCRIPTION OF DRAWINGS

Reference is now made to the following descriptions taken in conjunction with the accompanying drawings.

DETAILED DESCRIPTION

Various embodiments of a bra are described according to the present disclosure. Various embodiments of a leotard including a built-in bra is also described according to the present disclosure. It is to be understood, however, that the following explanation is merely exemplary in describing the devices and methods of the present disclosure. Accordingly, several modifications, changes, and substitutions are contemplated.

Figure 1:
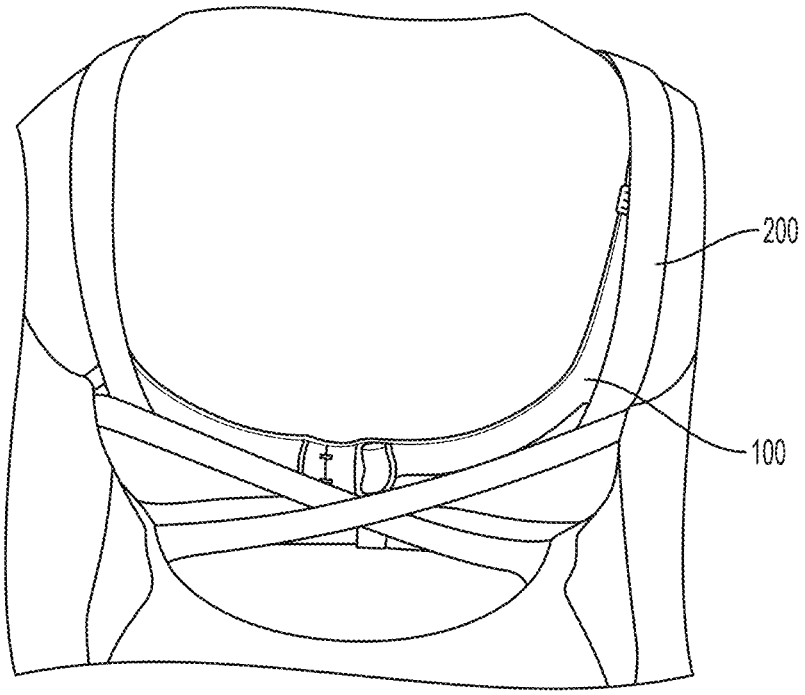
FIG. 1 illustrates a conventional bra as worn under a low-cut back leotard.
Figure 2:
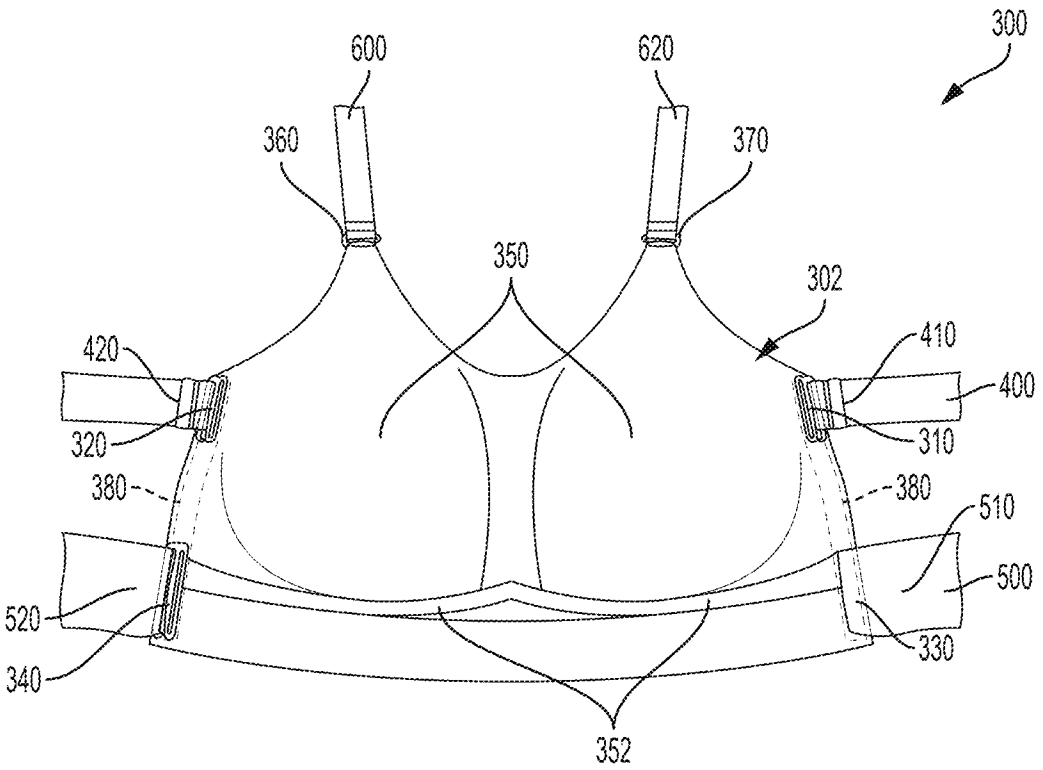
FIG. 2 is a front view of a bra according to an embodiment of the present disclosure.

FIG. 2 shows a bra 300 in accordance with one embodiment of the present invention. The bra 300 preferably includes a main body 302 having cup members 350. The cup members 350 may be any size from AA cup and up. In an embodiment, the cup members 350 are sized C and up to provide support for wearer with larger busts during active application. In accordance with a preferred embodiment of the present invention, each cup member 350 may further include underwire members 352. Each cup member 350 may include individual underwire member 352, or, alternatively, a single unitary underwire member 352 may extend through both cup members 350. In an embodiment, the main body 302 may include(s) boning strips or a rigid fabric or material 380 on the sides. The boning strips 380 may be made from plastic, silicon or any other appropriate material. The boning strips 380 may be disposed and secured inside the bra main body 302 so that they are hidden by bra fabric. The boning strips or a rigid fabric 380 provide structural support to the sides of the bra main body 302 and allows fasteners and bra straps to be securely attached to the bra main body 302.

Bra 300 further includes a top back strap 400, and a bottom back strap 500, both of which are attachable to the main body 302. The top back strap 400 includes a left end 410 and right end 420. The left end 410 of the top back strap 400 is attachable to the main body 302 via a top back strap left fastener 310, and the right end 420 of the top back strap 400 is attachable to the main body 302 via a top back strap right fastener 320. In an embodiment, the fasteners 310 and 320 are secured onto the bra main body 302 by being sewn, glued, bonded or otherwise attached to the side panels 380 within the bra main body 302. The bottom back strap 500 includes a left end 510 and a right end 520. In an embodiment of the present invention, the left end 510 of the bottom back strap 500 is attached to a bottom section 330 of the main body 302, and the right end 520 of the bottom back strap 500 is attachable to the main body 302 via a bottom back strap fastener 340. In an embodiment, the bottom back strap 500 and the fastener 340 are secured onto the bra main body 302 by being sewn, glued, bonded or otherwise attached to the side panel of the bra within the bra main body 302.

Bra 300 further includes shoulder straps 600 and 620, each disposed on top of a respective cup member 350. The shoulder straps 600 and 620 are attachable, at first ends of the shoulder straps, to shoulder strap fasteners 360 and 370 respectively. The shoulder straps 600 and 620 are attachable, at second ends of the shoulder straps, to the top back strap 400. Details of how the shoulder straps 600 and 620 are attachable at the first ends to the shoulder strap fasteners 360 and 370 will be discussed below in reference to FIG. 8, and the details of how the shoulder straps 600 and 620 are attachable at the second ends to the top back strap 400 will be discussed below in reference to FIGS. 9 and 10A-10C.

Bra main body 302 may be made from material appropriate for support, comfort and transparency. In an embodiment of the invention, the bra main body 302 is made from polyester, cotton, nylon, polyamide, LYCRA, spandex, blended synthetic fibers, viscose, elastane, power mesh and/or polyurethane. The bra main body 302 may be of any color. In an embodiment of the invention, the main body 302 may be any color that blends in with the skin tone of the wearer. The main body 302 may also be transparent, and be made from transparent material selected from the group consisting of polyester, nylon, elastane, polyamide, LYCRA, spandex, blended synthetic fibers, cotton, viscose, power mesh and polyurethane.

Figure 3:
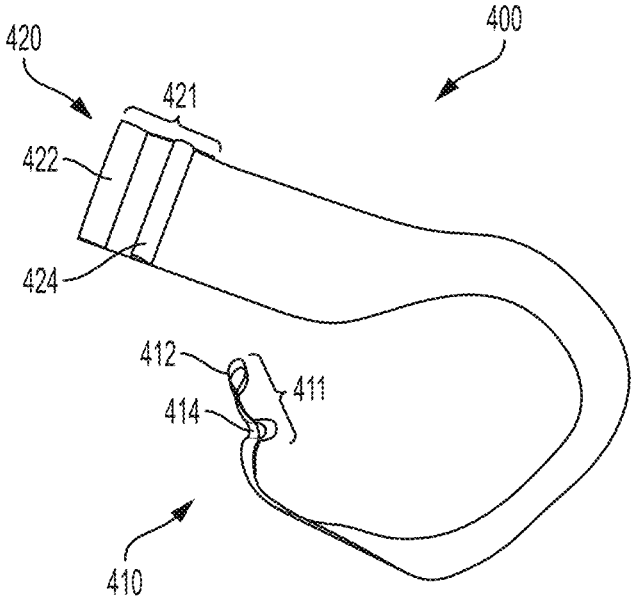
FIG. 3 is a perspective view of an embodiment of a top bra strap.

FIG. 3 discloses an enlarged view of the top back strap 400. As discussed above with respect to FIG. 2, the top back strap 400 includes a left end 410 and right end 420. In an embodiment of the present invention, each end of the top back strap 400 includes a fastener. For example, the left end 410 of the top back strap 400 includes a left fastener 411, and the right end 420 of the top back strap 400 includes a right fastener 421. In an embodiment of the present invention, the fasteners 411 and 421 each include a number of loops capable of receiving a hook fastening mechanism. As shown in FIG. 3, the left fastener 411 includes a first left loop 412 disposed at a distal end of the top back strap 400, and the right fastener 421 includes a first right loop 422 disposed at a distal end of the top back strap 400 opposite from the first left loop 412. It should be appreciated that more than one such receiving loops can be included in the left and right fasteners 411 and 421. In an embodiment of the present invention, the left fastener 411 may also include a second left loop 414 disposed near the first left loop 412, and the right fastener 421 may also include a second right loop 424 disposed near the first right loop 422.

Figure 4:
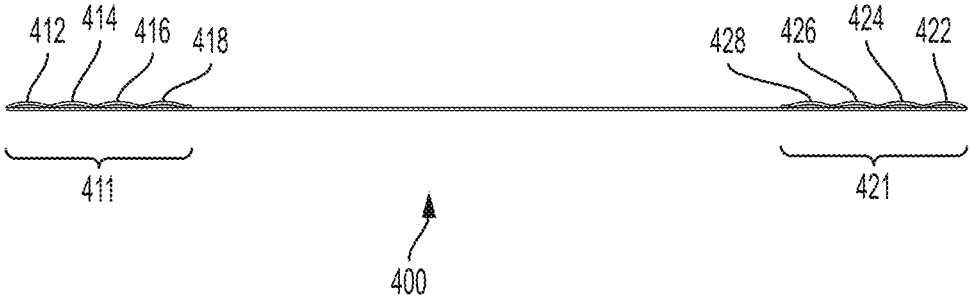
FIG. 4 is a side view of another embodiment of the top bra strap.

FIG. 4 discloses an embodiment of the top back strap 400, where each fastener 411 and 421 of the top back strap 400 includes more than two loops. Specifically, left fastener 411 includes a first left loop 412, second left loop 414, third left loop 416, and fourth loop 418. Right fastener 421 includes a first right loop 422, a second right loop 424, and third right loop 426, and a fourth right loop 428. The top back strap 400 may approximately 20-40 mm wide, and 450-500 mm long. Each loop may be 15-25 mm in width as measured along the length of the top back strap, and a small gap of approximately 2-3 mm may be disposed between each loop. It should be appreciated that the dimensions of the top back strap above can be varied as needed.

Figure 5:
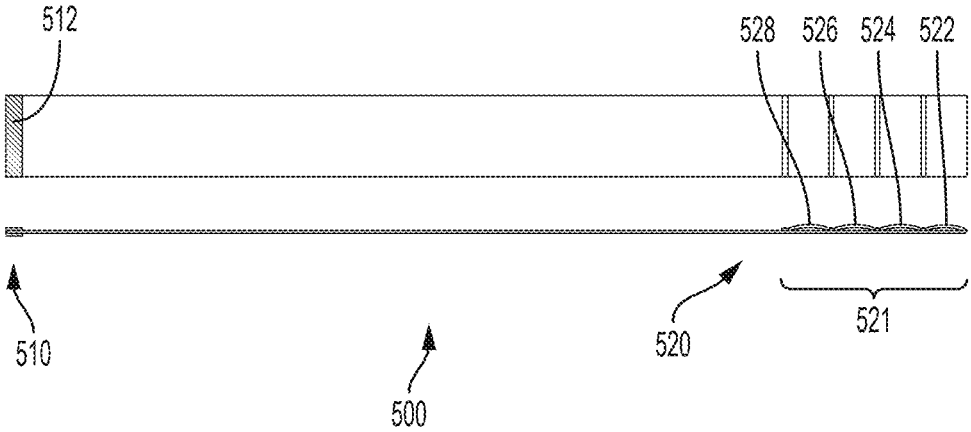
FIG. 5 is a side view of an embodiment of a bottom bra strap.

FIG. 5 illustrates an embodiment of the present invention of the bottom back strap 500. As discussed in FIG. 2 above, the bottom back strap includes a left end 510 and right end 520. A bottom back strap fastener 521 of the bottom back strap 500 may be disposed on either the left end 510 or right end 520. In an embodiment of the present invention, the bottom back strap fastener 521 is disposed on the right end 520, and includes a bottom strap loop 522 at a distal end of the bottom back strap 500. In an embodiment of the present invention, the bottom back strap fastener 521 may include any number of loops. As illustrated in FIG. 5, the bottom back strap fastener 521 may include the first bottom strap loop 522, second bottom strap loop 524, third bottom strap loop 526, and fourth bottom strap loop 528. Similar to the loops disposed on the top back strap 400, the loops of the bottom back strap fastener 521 may be approximately 20 mm wide, and a small gap of approximately 2-3 mm is disposed between each loop.

As discussed above, bottom back strap 500 includes a bottom back strap fastener 521 disposed on one end of the bottom back strap 500. At the end opposite to the where the bottom back strap fastener 521 is located, the bottom back strap 500 may be attached to the bra body 302 without using a loop or other detachable fastener mechanism. Specifically, the bottom back strap 500 may be directly attached to the bra body 302 at the left end 510 by means of being sewn, glued or bonded onto the bra body 302. In an embodiment, the left end 510 of the bottom back strap 500 includes a reinforced piece 512 that is sewn, glued or bonded to side panel of bra 380 so as to be securely attached to the bra main body 302. By using an attachment method different from the loop fasteners as previous discussed, the bottom back strap 500 is attached to the bra body 302 so that the bottom back strap 500 is difficult to detach from the bra body 302. This is so that the bottom back strap 500 is more securely fastened to the bra at one end 510. The other end of the bottom back strap 500 includes loops 520, which allows the wearer to select the loop to be used with a fastener, thereby adjusting the strap length of the bottom back strap 500. The bottom back strap 500 may be different in dimension when compared to the top back strap 400. In an embodiment of the present invention, the bottom back strap 500 may be 30-50 mm wide and 400-600 mm long. In an embodiment, the bottom back strap is wider than the top back strap so as to provide more bottom side support for wearer with larger bust. Both the top and bottom back straps 400 and 500 may be made from any material suitable to secure the bra body 302 onto to wearer. In an embodiment, the straps 400 and 500 are made from plastic. In other embodiments, the straps 400 and 500 are made from LYCRA, nylon, elastane, spandex, monofilament, silicone, polyamide, polyester, blended synthetic fibers, cotton, viscose or TPU (thermoplastic polyurethane).

In an embodiment, the top back strap 400 and the bottom back strap 500 are easily manufactured, as an end of a length of bra strap material can be simply folded and attached to itself at intermittent intervals (forming the gaps discussed above) so that the bra strap material forms the loops shown in FIGS. 4 and 5. The top back strap 400 and bottom back strap 500 may be transparent, flexible, and stretchable, so as to better adapt and support the wearer during physical activity.

Figure 6:
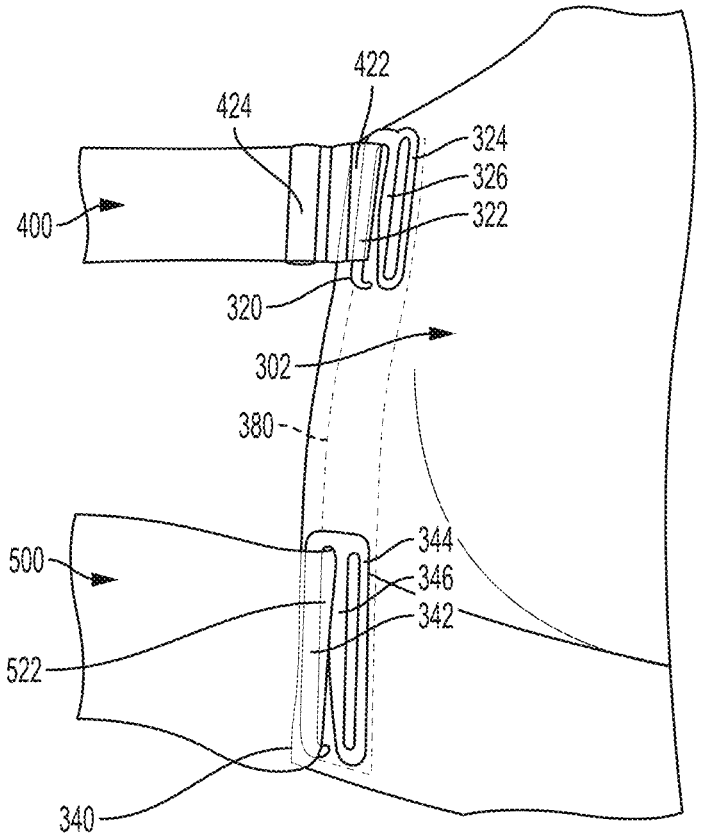
FIG. 6 is an expanded view of the right side of the bra as shown in FIG. 2.

FIG. 6 illustrates a right side of the bra 300 in detail, where the top back strap 400 and bottom back strap 500 are fastened to the bra main body 302 via the top back strap right fastener 320 and bottom back strap fastener 340 respectively. In an embodiment, the fasteners 320 and 340 are attached to the bra main body 302 by being sewn, glued or bonded onto the side panel of bra 380 that is within the bra main body 302. In an embodiment, the fastener 320 includes a hook end 322 and a closed end 324, where the two ends are separated by a divider 326. In order to attach the top bra strap 400 to the main bra body 302, a loop, shown in FIG. 6 as first right loop 422, is inserted to accept the hook end 322 of the fastener 320, where the hook and tension on the bra strap will keep the bra strap relatively in place. If the user wants to adjust the length of bra strap, the user may select a different loop (e.g. second right loop 424) to insert to accept the hook end 322. Similarly, the bottom strap 500 may be attached to the bra main body 302 using a similar method, by inserting the first bottom strap loop 522 to accept a hook end 342 of the bottom back strap fastener 340. The bottom back strap fastener 340 may also include the closed end 344 and divider 346 as shown. In an embodiment, the bottom back strap fastener 340 may include an additional closed end (not shown), where a hook is disposed between two closed ends. In this way, both closed ends are sewn to the bra and the hook is operable to be inserted into a loop, so the bra and/or leotard fabric will lay flat when the strap is pulled on.

Figure 7:
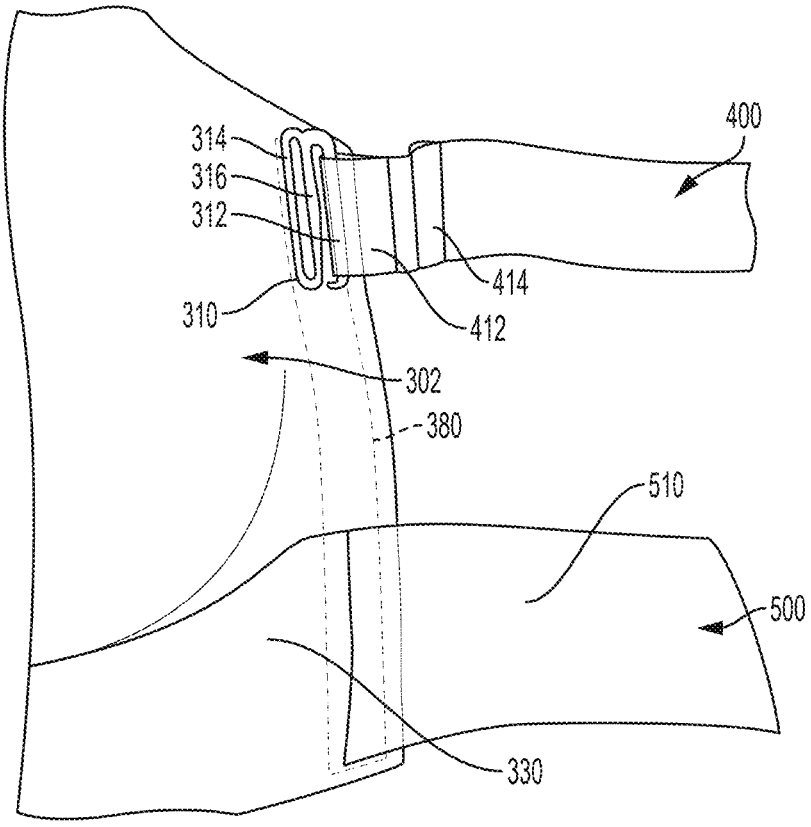
FIG. 7 is an expanded view of the left side of the bra as shown in FIG. 2.

FIG. 7 illustrates a left side of the bra 300 in detail, where the top back strap 400 and bottom back strap 500 are attached to the bra main body 302. In an embodiment, the top back strap 400 is attached to a top back strap left fastener 310 that is attached to the bra main body 302. The fastener 310, similar to the other fasteners 320 and 340, include a hook end 312, closed end 314, and divider 316. To perform the attachment, a loop (e.g. first left loop 412) is inserted to accept the hook end 312 where the hook and tension on the bra strap will keep the bra strap relatively in place. If the user wants to adjust the length of bra strap, the user may select to insert a different loop (e.g. second left loop 414) to accept the hook end 312. In an embodiment, the left end of the bottom strap 510 is attached to the left bottom end 330 of the bra main body 302 in a non-detachable manner. For example, the left end of the bottom strap 510 may be sewn, glued or bonded onto the side panel of bra 380 within the bra main body 302 at the left bottom end 330. In an embodiment, the left end of the bottom bra strap 510 may include loop type fasteners similar to fastener 521, and the left bottom end 330 of the bra main body 302 would include a hook type fastener that may be inserted into the loop fastener of the left end of bottom bra strap 510. In this embodiment, the bottom back strap 500 would be similar to the top back strap 400 in that both straps would include a number of loop fasteners disposed on distal ends of the straps.

Figure 8:
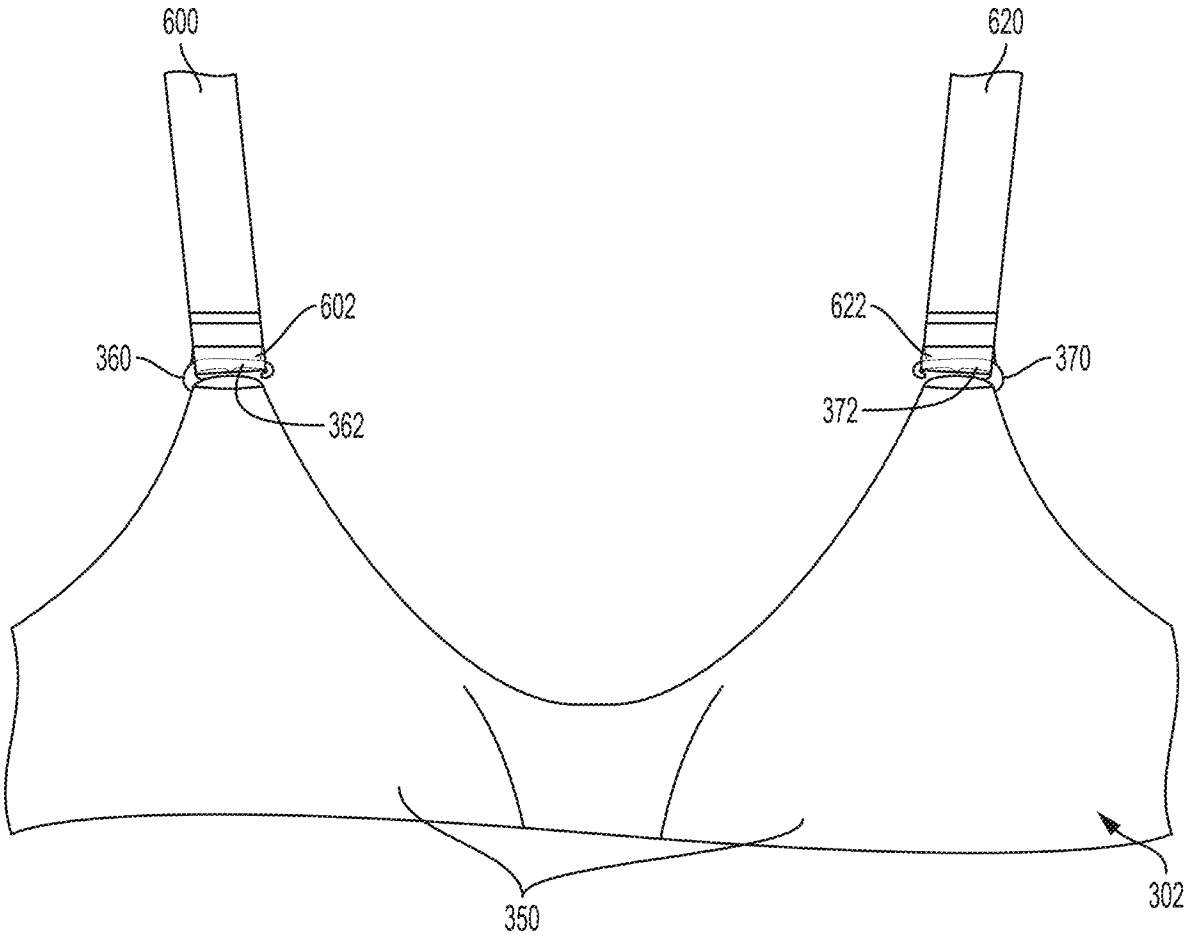
FIG. 8 is an expanded view of the top side of the bra as shown in FIG. 2.

FIG. 8 illustrates how shoulder straps 600 and 620 may be coupled to the bra main body 302. Shoulder straps 600 and 620 each include a shoulder strap loop 602 and 622 at the ends of the respective shoulder strap. Bra main body 302 includes two cup members 350, where shoulder strap fasteners (360, 370) are attached above respective cup members 350. To fasten the shoulder straps onto the bra main body 302, shoulder strap loop 602 is inserted to accept a shoulder strap hook 362 of the shoulder strap fastener 360, and a shoulder strap loop 622 is inserted to accept a shoulder strap hook 372 of the shoulder strap fastener 370. In embodiments discussed in view of FIG. 10A-C, each shoulder strap 600 may include additional loops or other fastener types to connect to the bra main body 302 so that the shoulder straps 600 may be adjustable in length. In an embodiment, the hook type fasteners 310, 320, 340, 360 and 370 may be made from any type of metal, plastic, or any other material that such fasteners may be made from. The fasteners 360 and 370 may be structurally the same as fasteners 310, 320 and 340, having hook end, closed end, and divider portion. The fasteners 310, 320, 340, 360 and 370 may be appropriately dimensioned so as to receive the full width and loop of the respective straps into the hook section.

Figure 9:
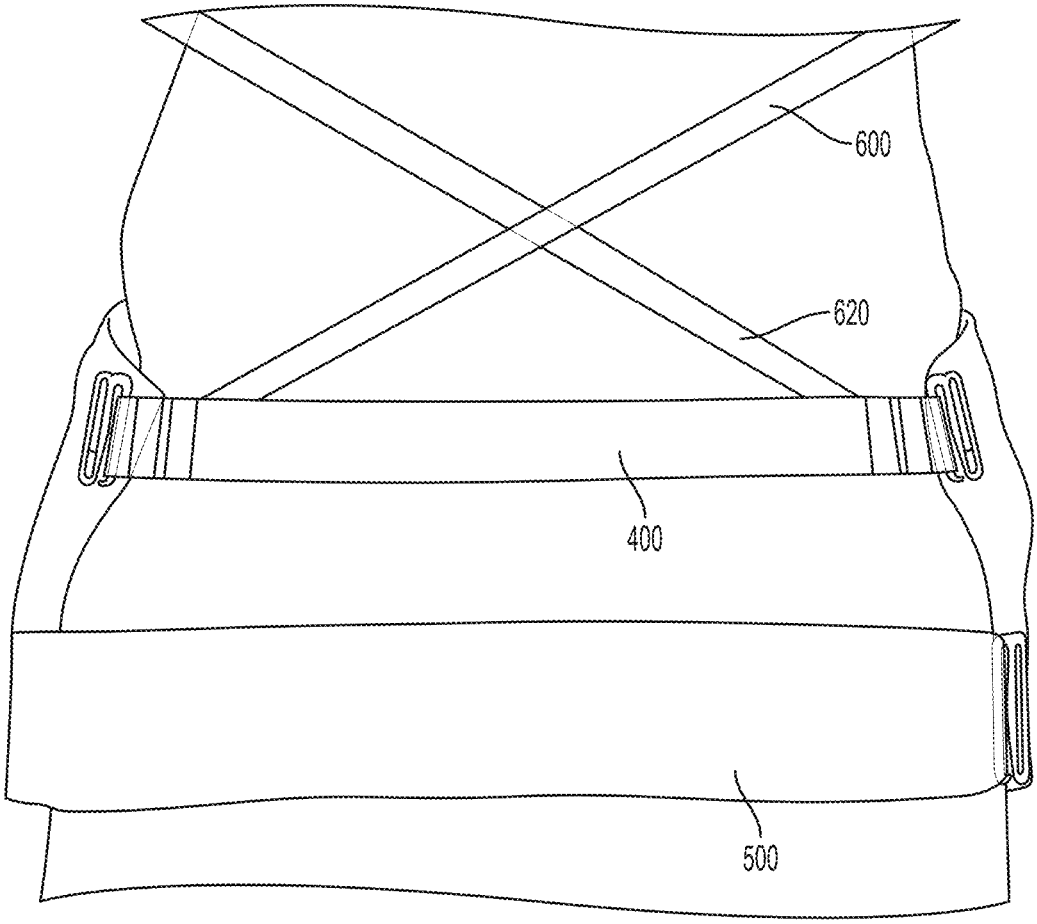
FIG. 9 is a back view of the bra according to an embodiment of the present disclosure.

FIG. 9 illustrates an embodiment of the configuration of the bra straps usable by the wearer. In this "X" strap configuration, the shoulder straps 600 and 620 are coupled on the sides of the top back strap 400 so that the shoulder straps cross each other to form an "X" around the shoulder area of the wearer. In a particular embodiment, each shoulder strap is permanently fused to the top bra strap 400. The other ends of the shoulder straps are coupled to the bra main body 302 as discussed above in view of FIG. 8.

Figure 10A:
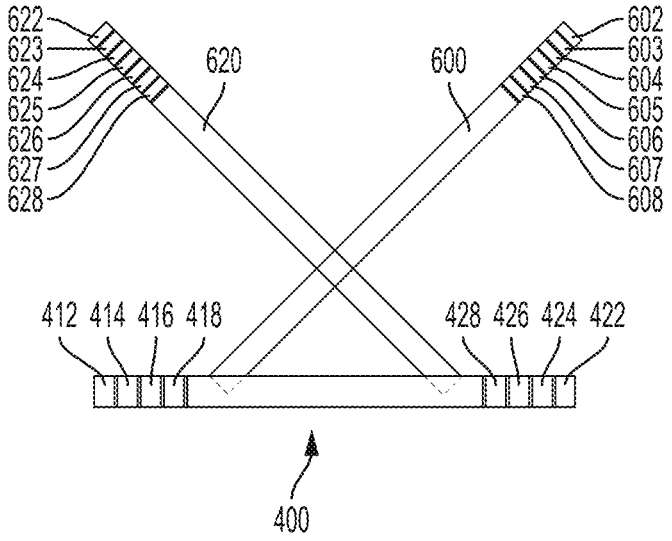
FIG. 10A is a view of the shoulder straps attached to the top bra strap, where the shoulder straps are in a first configuration.

FIG. 10A illustrates the "X" strap configuration of the top bra strap 400 and shoulder straps 600 and 602 in greater detail. In this embodiment, the top back strap 400 includes fastening loops 412, 414, 416 and 418 on the left side, and loops 422, 424, 426 and 428 on the right side as discussed in view of FIG. 4. The shoulder strap 620 include a number of fastening loops 622-628 disposed on a front end, and shoulder strap 600 include a number of fastening loops 602-608 disposed on a front end. Back ends of the shoulder straps 600 and 620 are coupled near opposing ends of the top back strap 400 so that the shoulder straps 600 and 620 cross each other, forming an "X" around the shoulder area of the wearer. It should be understood that while each of the shoulder straps are shown to include 7 fastening loops, any number of fastening loops (e.g. 1-10) may be disposed at the front end of the shoulder straps so that the wearer can easily adjust the length of the shoulder straps.

Figure 10B:
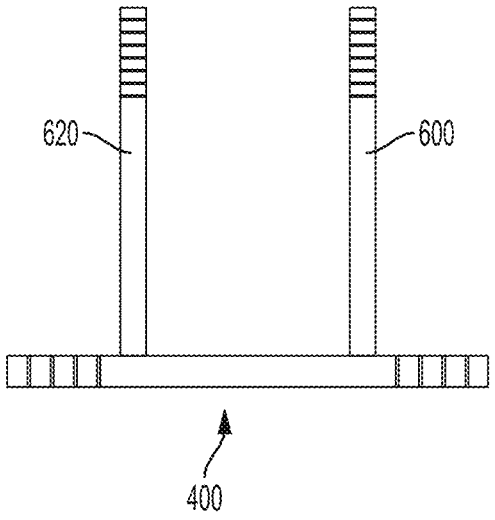
FIG. 10B is a view of the shoulder straps attached to the top bra strap, where the shoulder straps are in a second configuration.

FIG. 10B illustrates the "classic" strap configuration of the top bra strap 400 and shoulder straps 600 and 602. In this configuration, the front ends of shoulder straps 600 and 620 are attached to the bra main body 302 as discussed in view of FIG. 4. The straps 600 and 620 then extend over the mid-shoulder section and run down the wearer's back, where the back ends of the shoulder straps are attached toward respective ends of the top back strap 400 so that the shoulder straps 600 and 620 appear substantially parallel to each other at the wearer's back. The top bra strap 400 and shoulder straps 600 and 602 are illustrated with multiple fastening loops as shown in FIG. 10A, but it should be understood that any number of fastening loops may be disposed on the straps.

Figure 10C:
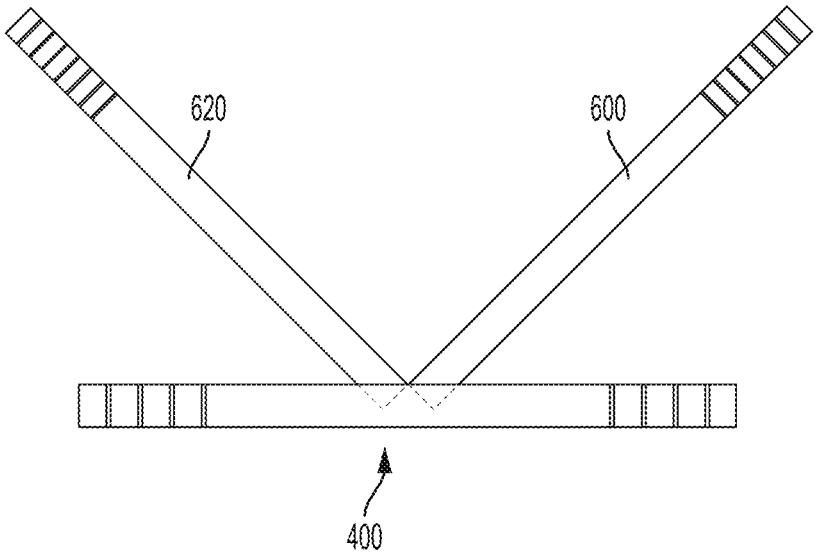
FIG. 10C is a view of the shoulder straps attached to the top bra strap, where the shoulder straps are in a third configuration.

FIG. 10C illustrates a "center-fuse" strap configuration of the top bra strap 400 and shoulder straps 600 and 602. In this configuration, the front ends of shoulder straps 600 and 620 are attached to the bra main body 302 as discussed in view of FIG. 4. The straps 600 and 620 then extend over the mid-shoulder section and run down the wearer's back, where the back ends of both shoulder straps are attached to substantially the center of the top back strap 400. The top bra strap 400 and shoulder straps 600 and 602 are illustrated with multiple fastening loops as shown in FIG. 10A, but it should be understood that any number of fastening loops may be disposed on the straps.

The bra 300 as disclosed above provides bust support for larger-busted women, and yet remains practically invisible under leotards, costumes, tank tops, low-cut tops, tennis outfits, gowns, cutaway tops, lacey tops, dresses, dance leotards, and other types of outer wear. The bra main body 302 may include cup members 350 that support a range of bust sizes, including cup sizes A through D and up. The straps 400, 500, 600 and 620 may be made from matte plastic, LYCRA, nylon, elastane, spandex, monofilament, TPU (thermoplastic polyurethane), silicone, polyamide, polyester, blended synthetic fibers, cotton, viscose or any other flexible and easily molded material. In an embodiment, the straps 400, 500, 600 and 620 are clear, transparent, or otherwise barely visible to the eye when worn. The straps 400, 500, 600 and 620 may also be different colored or patterned so as to blend in with the wearer's clothing, skin tone, and/or aesthetic desire. Particularly, the shoulder straps 600 and 620 may be between 300 to 400 mm in length, between 20 to 30 mm in width, where the fastener loops disposed on the shoulder straps are 5 to 15 mm in width as measured along the length of the shoulder straps.

Although the bra 300 has been described to be particular useful for supporting active women with larger bust size, it will be appreciated that this disclosure is not limited to such use and not limited to the structure disclosed above. For example, the fasteners discussed need not be hook & loop type fasteners, but may also be hook & eyes, buckles, brackets, snap fasteners, or any other type of appropriate fasteners.

Figure 11A:
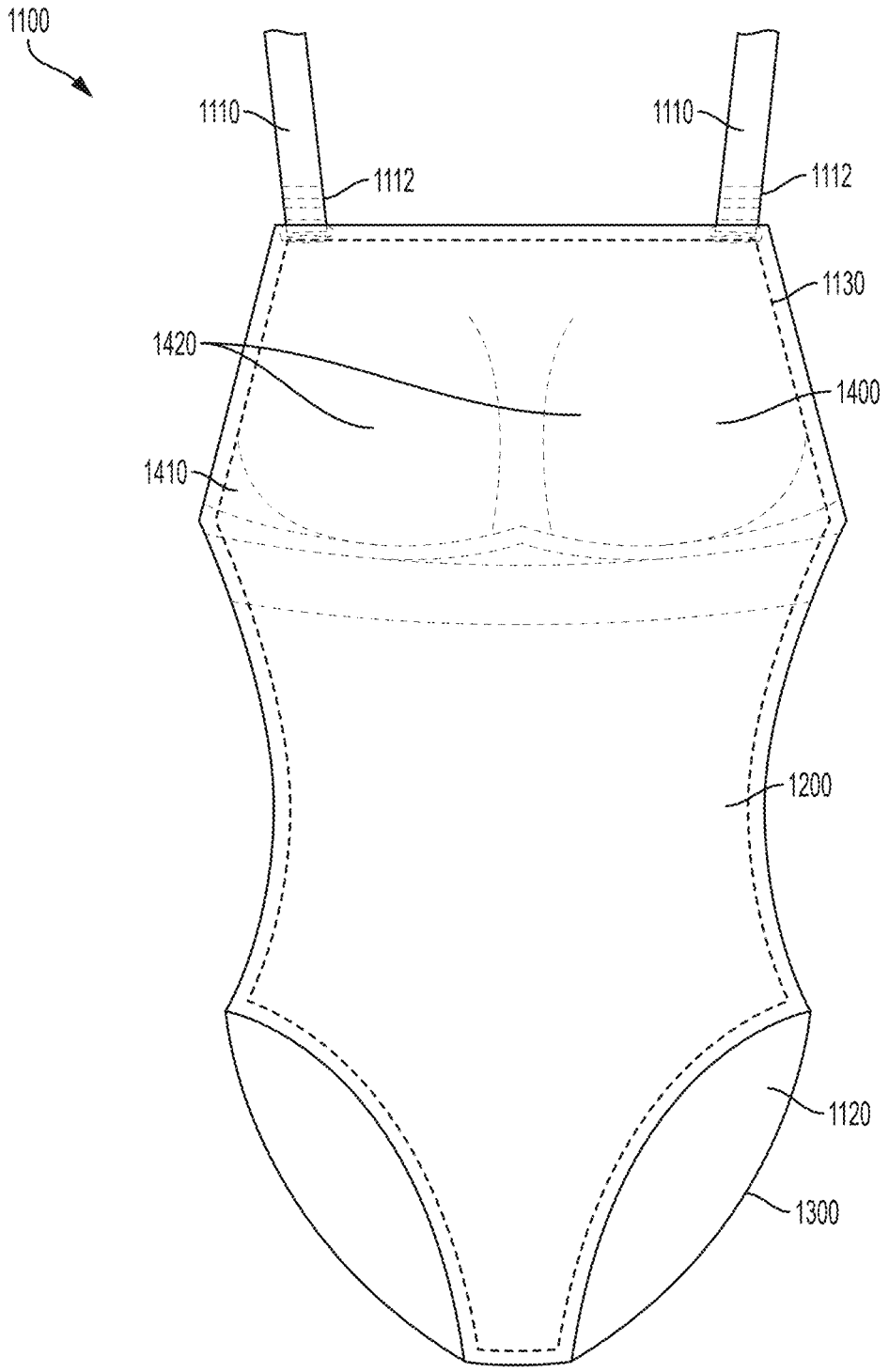
FIG. 11A is a front plan view of the front of a leotard including a built-in bra according to the present disclosure.

FIG. 11A discloses a leotard 1100. The leotard 1100 comprises of a front panel 1200 and a back panel 1300, each made from flexible and stretchable material. For example, the leotard 1100 may be made from polyester, silicon, polyamide, elastane, LYCRA, spandex, cotton, nylon, viscose or blended synthetic fibers. The leotard 1100 further includes a built-in bra 1400 for providing support for wearer having larger busts as discussed above. The leotard also includes shoulder straps 1110, which are arranged to be disposed over the shoulders of the wearer. In an embodiment, the shoulder straps 1110 may include one or more loops 1112 disposed on the back/wearer side of the straps 1110. Each of the loops 1112 may receive a shoulder strap hook of the built-in bra 1400, the details of which are discussed below. In an embodiment discussed in more detail below, the front panel 1200 is disposed over the shoulder strap hook of the built-in bra so as to hide the hook from view. Leotard also includes leg openings 1120 for the legs of the wearer. In an embodiment, the back panel 1300 may include silicon strips disposed on the inside of the back panel 1300 near leg openings 1120 and below the buttocks, so as to keep the back panel in place relative to the wearer. In an embodiment, the front panel 1200 includes thicker and extra fabric in the nipple area of the bra so as to keep the fabric smooth around the location.

The leotard may include a stitch seam 1130 that runs along the edge of the front panel 1200. In an embodiment, the front panel 1200 and the back panel 1300 are sewn, glued or bonded together at portions of the stitch seam 1130 so as to form the leotard 1100. In another embodiment, the leotard 1100 is formed from a single piece of flexible material, and the front panel 1200 and back panel 1300 describe the front and back sides of the leotard 1100 respectively. The terms front panel 1200 and back panel 1300 are not limiting. For all subsequent discussion of the front panel 1200 and back panel 1300, each description may refer to two separate pieces of fabric or two portions of a single piece of fabric as disclosed above.

Built-in bra 1400 is similar in structure to the supportive bra 300 as disclosed in FIG. 2, duplicative disclosure being omitted herein. Bra 1400 includes a main body 1410 with cup members 1420. The cup members 1420 may be any size from AA up and up. In an embodiment, the cup members 1420 are sized C and up to provide support for wearer with larger busts. In an embodiment, the built-in bra 1400 is attached to the front panel 1200 along the edge of the bra 1400. The bra 1400 may be sewn, glued, bonded, or otherwise securely attached to the front panel 1200.

Figure 11B:
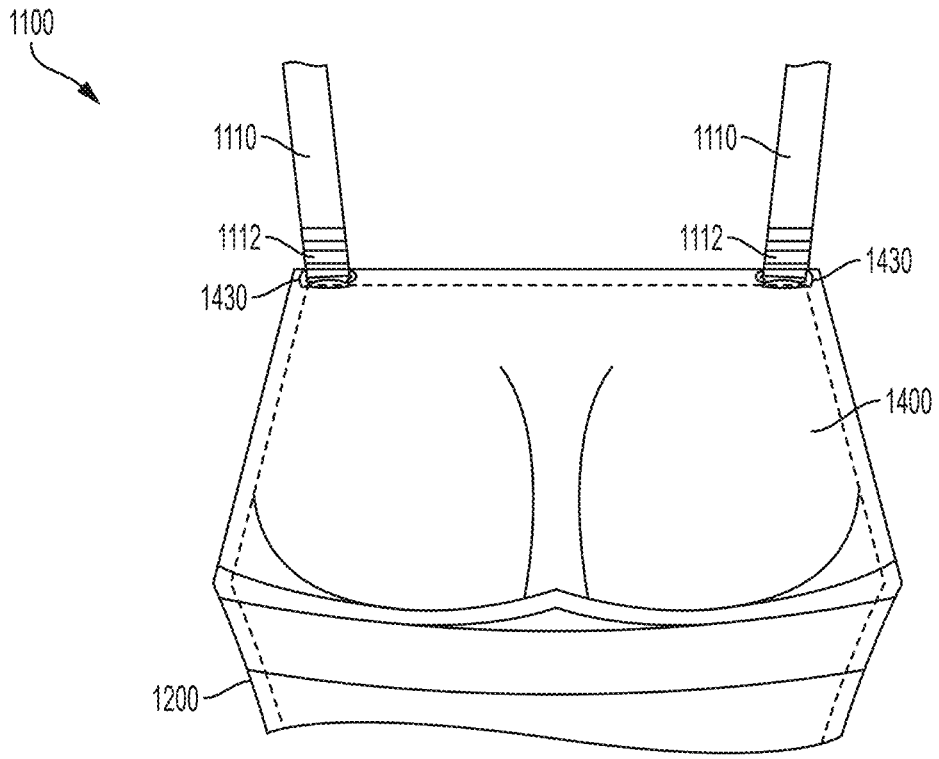
FIG. 11B is a rear view of a top portion of the front panel of the leotard including a built-in bra.

FIG. 11B discloses a rear view of the front panel 1200, having built-in bra 1400 attached thereon. Shoulder straps 1110, each having shoulder strap loops 1112, may be coupled to the built-in bra 1400 as discussed below. In an embodiment, the shoulder strap loops 1112 have the same structure and operate in the same way as the loops 602 to 608 and 622 to 628 as shown and disclosed in FIG. 10A. The bra 1400 is similar in construction to the bra 300 disclosed in FIG. 2, where the bra 1400 includes shoulder strap fasteners 1430. In an embodiment, each of the shoulder strap fasteners 1430 can be fastened and secure onto shoulder strap loops 1112 in the same way that shoulder strap fastener 360/370 are fastened to the shoulder strap loops 602 to 608/622 to 628 as disclosed above. As such, the wearer of the leotard 1100 may easily adjust the strap length of the bra 1400 as desired. The shoulder strap fasteners 1430 are attached to the bra 1400 where front panel 1200 obscures the view of the shoulder strap fasteners 1430 when viewed from front (see FIG. 11A). In this way, the shoulder strap 1110 and front panel 1200 appear integrated and maintains an antithetically pleasing appearance. In an embodiment, the shoulder straps 1110 are covered with the same material as the front panel 1200. In an embodiment, the shoulder straps 1110 each may include a piece of silicon that runs along the length of the straps so as to keep the straps in place relative to the wearer's shoulders.

Figure 12:
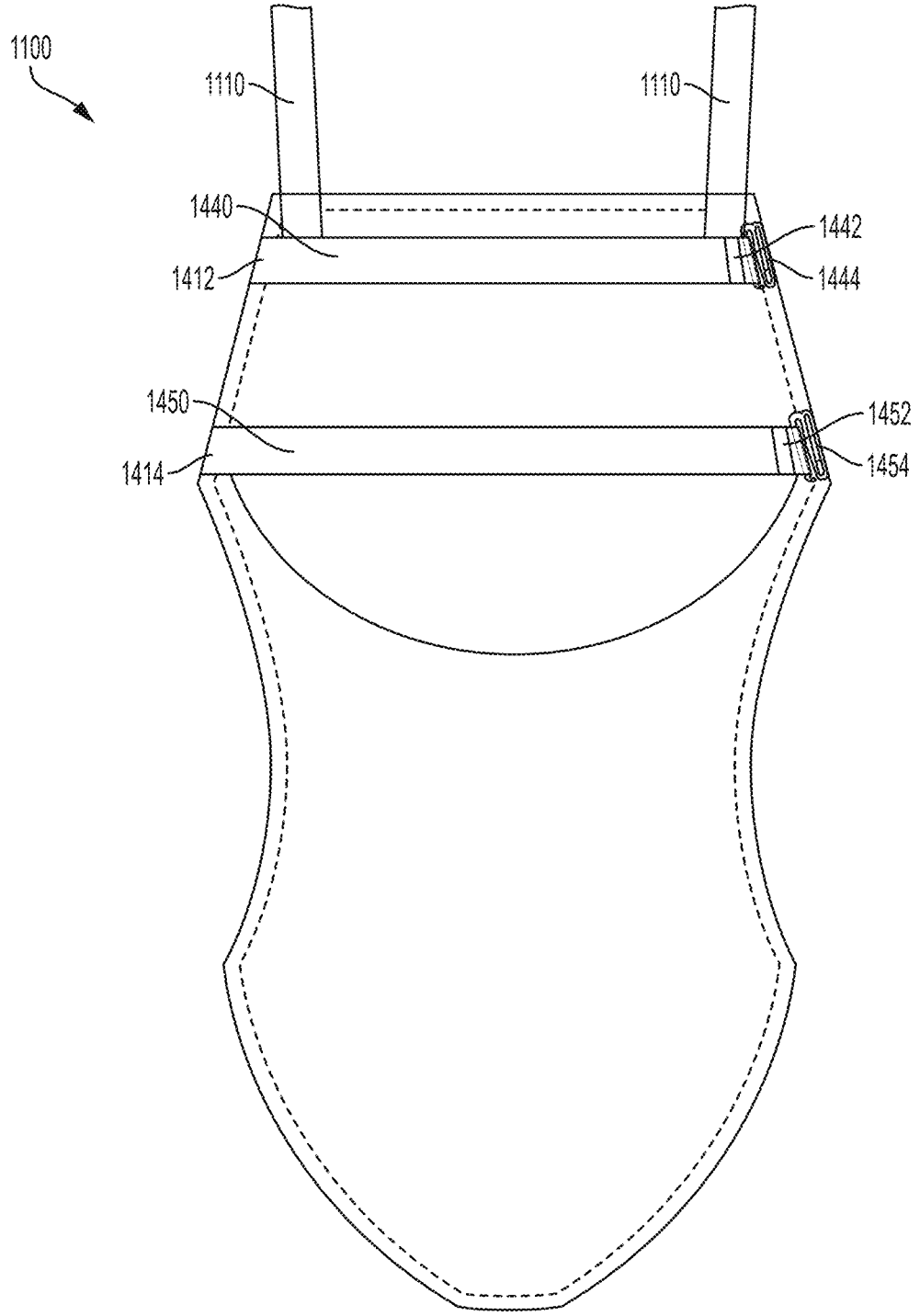
FIG. 12 is a rear plan view of the leotard including a build-in bra.

FIG. 12 discloses a rear view of the leotard 1100 including the built-in bra 1400. The shoulder straps 1110 of the leotard 1100 are coupled to a top back strap 1440 of the bra 1400 in the same way that shoulder straps are attached to a top back strap for bra 300 discussed above. In other words, without duplicating the above disclosure, shoulder straps 1110 may be coupled to top back strap 1440 in the same way that shoulder straps 600 and 620 are attached to top back strap 400 as shown in FIGS. 10A, 10B, and 10C and described in the corresponding paragraphs. The top back strap 1440 may include one or more top back strap loops 1442. A top back strap fastener 1444 is attached to the right top edge of the bra main body 1410, and the top back strap fastener 1444 can be adjustably coupled and secured to the top back strap 1440 using the top back strap loops 1442. The top back strap 1440 is further secured onto the left side of the bra main body at location 1412. A bottom back strap 1450 may include one or more bottom back strap loops 1452. A bottom back strap fastener 1454 is attached to the right bottom edge of the bra main body 1410, and the bottom back strap fastener 1454 can be adjustably coupled and secured to the bottom back strap 1450 using the bottom back strap loops 1452. The bottom back strap 1450 is further secured onto the left side of the bra main body at location 1414. In an embodiment, the top and bottom back straps 1440 and 1450 are secured to the right side of the bra main body 1410 using fasteners 1444 and 1454 in similar fashion as disclosed in FIG. 6, detailed discussion is omitted herein to avoid duplicative disclosure.

Figure 13:
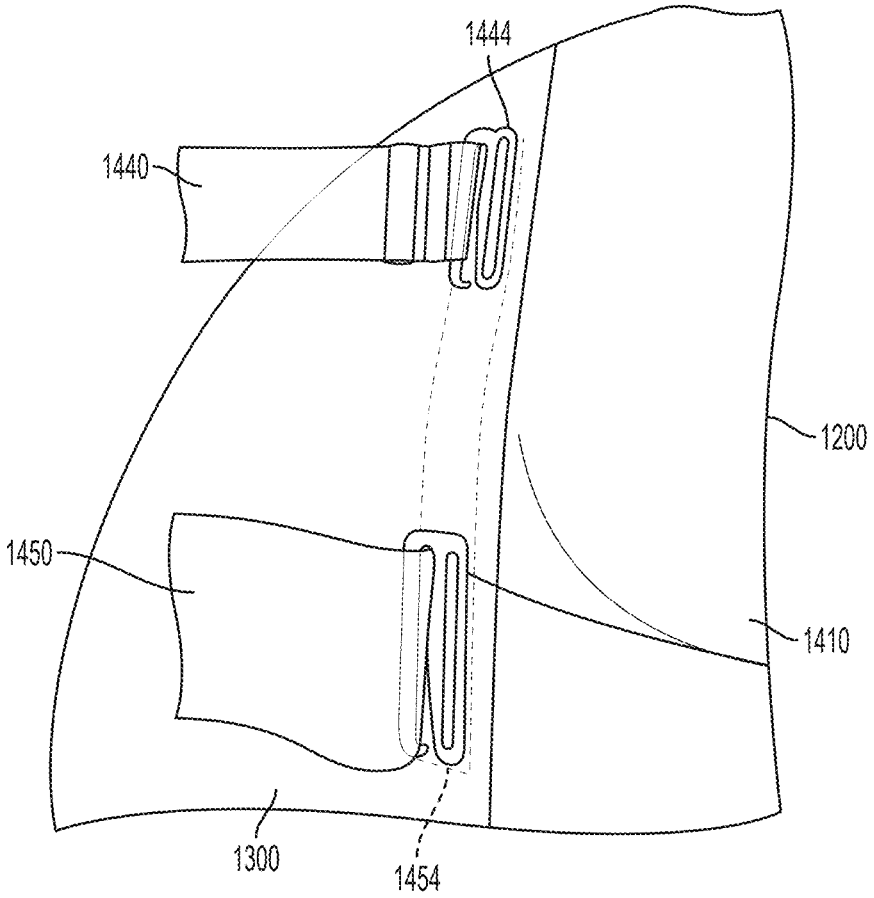
FIG. 13 is an expanded view of the right side of the leotard.

FIG. 13 discloses an expanded view of the right side of the leotard. The back straps 1440 and 1450 are shown to be coupled to the fasteners 1444 and 1454 in similar fashion as shown in FIG. 6. The front panel 1200 of the leotard is attached to and covers the bra main body 1410. The back panel 1300 of the leotard is further attached to and covers the back strap fasteners 1444 and 1454 so that the fasteners are hidden from view.

Figure 14:
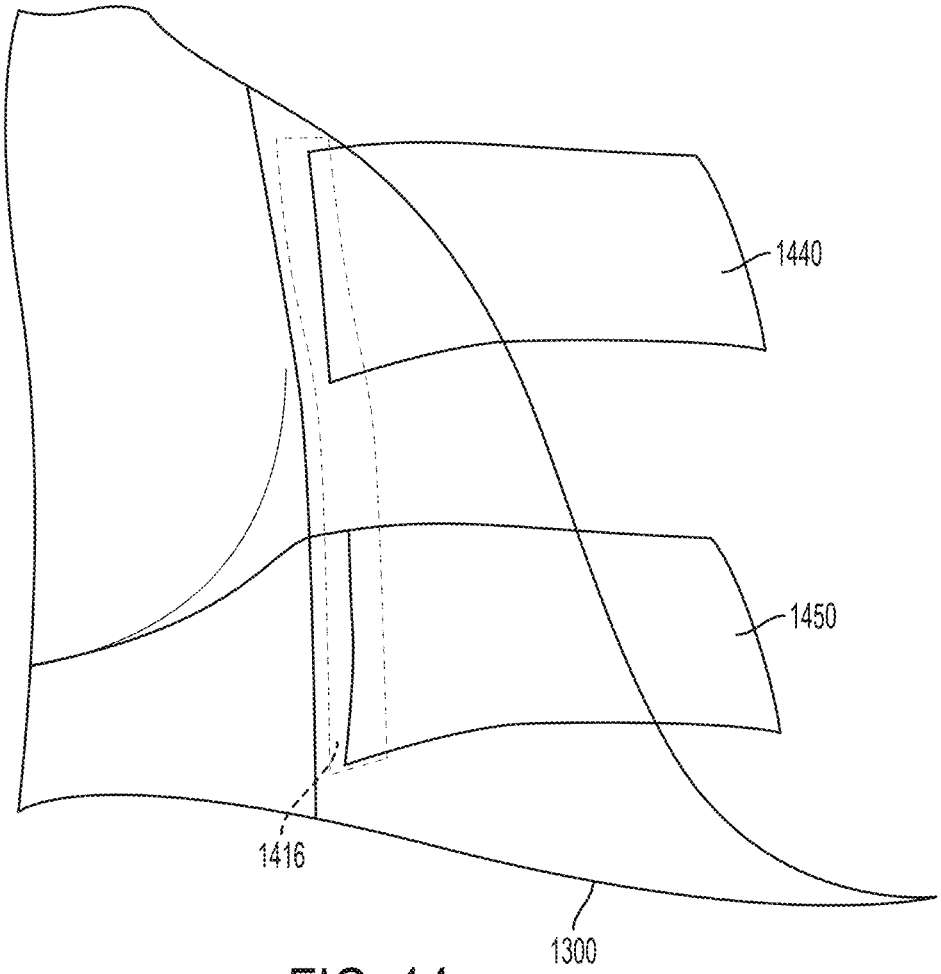
FIG. 14 is an expanded view of the left side of the leotard.

FIG. 14 discloses an expanded view of the left side of the leotard. The back straps 1440 and 1450 are shown to be coupled to the bra 1400 in similar fashion as shown in FIG. 7 where bottom back strap 500 is coupled to the bra main body 302. Specifically, the back straps 1440 and 1450 are secured onto the side panel 1416 of the main body, where the boning strip, if used, is hidden from view by the back panel 1300.

FIGS. 11A to 14 disclose a leotard embodiment. However, it should be noted that descriptions for FIGS. 2 to 10C can be applied to the leotard embodiment where appropriate. For example, shoulder straps 1110 may have the same dimension, material, and other properties as shoulder straps 600 and 620 as disclosed. Top back strap 1440 and bottom back strap 1450 may have the same dimension, material, and other properties as top back strap 400 and bottom back strap 500 respectively. Shoulder straps 1110 may be arranged and attached to top back strap 1440 as disclosed on FIGS. 10A to 10C. The top back strap 1440 and bottom back strap 1450 may be coupled to and secured to the bra 1400 in similarly fashion as disclosed in FIGS. 6 and 7. In addition, all of the disclosed shoulder straps may include padding, have different width, and/or may not have straight edges (e.g. where shoulder strap is wider at the center and on top of the shoulders, and more narrow at the ends).

The breadth and scope of the present disclosure should not be limited by any of the above-described exemplary embodiments, but should be defined only in accordance with the following claims and their equivalents. For example, while the description discloses a leotard with a built-in bra, the disclosure is also applicable to swimwear or other similar articles of clothing, where a built-in bra is appropriate. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

The invention claimed is:

1. An article of clothing, comprising:

a front panel and a back panel combination to be worn over a torso area of a wearer;

a brassiere attached to the front panel;

a top fastener disposed on the brassiere;

a bottom fastener disposed on the brassiere;

a top back strap having a first end and a second end;

a bottom back strap having a first end and a second end;

the first end of the top back strap including at least one top back strap loop; and the first end of the bottom back strap including at least one bottom back strap loop, wherein the at least one top back strap loop is able to be coupled to the top fastener, the at least one bottom back strap loop is able to receive the bottom fastener, the second end of the top back strap is attached to the brassiere, and the second end of the bottom back strap is attached to the brassiere.

2. The article of clothing of claim 1, further comprising a first shoulder strap having a front end and a back end, and a second shoulder strap having a front end and a back end.

3. The article of clothing of claim 2, wherein the front end of the first shoulder strap includes one or more fastening elements, and the back end of the first shoulder strap is attached to the top back strap.

4. The article of clothing of claim 3, wherein the front end of the second shoulder strap includes one or more fastening elements, and the back end of the second shoulder strap is attached to the top back strap.

5. The article of clothing of claim 4, further comprising a first shoulder strap fastener disposed on the brassiere and a second shoulder strap fastener disposed on the brassiere.

6. The article of clothing of claim 5, wherein the first shoulder strap fastener and the one or more fastening elements of the first shoulder strap are adjustably couplable, and wherein the second shoulder strap fastener and the one or more fastening elements of the second shoulder strap are adjustably couplable so as to adjust a wearable length of the first and second shoulder straps.

7. The article of clothing of claim 6, wherein the front panel covers the first shoulder strap fastener and the second shoulder strap fastener so that the first shoulder fastener and the second shoulder strap fastener are obscured.

8. The article of clothing of claim 2, wherein the shoulder strap and the front panel are made from a same material.

9. The article of clothing of claim 1, further comprising a first shoulder strap having a front side and a back side, and a second shoulder strap having a front side and a back side, wherein fastening elements are disposed on the back side of the first shoulder strap and the back side of the second shoulder strap.

10. The article of clothing of claim 1, wherein the brassiere is sewn, glued, or bonded to the front panel.

11. The article of clothing of claim 1, wherein the brassiere has an edge and is sewn, glued, or bonded to the front panel along the edge.

12. The article of clothing of claim 1, wherein the top fastener includes a hook type fastener, a buckle type fastener, a bracket type fastener or a snap type fastener; and wherein the bottom fastener includes a hook type fastener, a buckle type fastener, a bracket type fastener or a snap type fastener.

13. The article of clothing of claim 1, wherein the top fastener includes a hook type fastener; and wherein the bottom fastener includes a hook type fastener, a buckle type fastener, a bracket type fastener or a snap type fastener.

14. The article of clothing of claim 1, wherein the top fastener includes a hook type fastener, a buckle type fastener, a bracket type fastener or a snap type fastener; and wherein the bottom fastener includes a hook type fastener.

15. The article of clothing of claim 1, wherein the top fastener includes a hook type fastener; and wherein the bottom fastener includes a hook type fastener.

16. The article of clothing of claim 1, wherein the brassiere is sewn, glued, or bonded to the front panel;

wherein the top fastener includes a hook type fastener, a buckle type fastener, a bracket type fastener or a snap type fastener; and wherein the bottom fastener includes a hook type fastener, a buckle type fastener, a bracket type fastener or a snap type fastener.

17. The article of clothing of claim 1, wherein the brassiere is sewn, glued, or bonded to the front panel;

wherein the top fastener includes a hook type fastener; and wherein the bottom fastener includes a hook type fastener.

18. The article of clothing of claim 1, wherein the brassiere has an edge and is sewn, glued, or bonded to the front panel along the edge;

wherein the top fastener includes a hook type fastener; and wherein the bottom fastener includes a hook type fastener.

19. The article of clothing of claim 6, wherein the first shoulder strap fastener includes a hook, wherein the one or more fastening elements of the first shoulder strap comprise a plurality of loops, wherein the second shoulder strap fastener includes a hook, and wherein the one or more fastening elements of the second shoulder strap comprise a plurality of loops.

20. The article of clothing of claim 18, wherein the first shoulder strap fastener includes a hook, wherein the one or more fastening elements of the first shoulder strap comprise a plurality of loops, wherein the second shoulder strap fastener includes a hook, and wherein the one or more fastening elements of the second shoulder strap comprise a plurality of loops.

* * * * *